US011633932B2

(12) United States Patent
González

(10) Patent No.: US 11,633,932 B2
(45) Date of Patent: Apr. 25, 2023

(54) CONTAINER PRE-CUTTING SYSTEM

(71) Applicant: INDUSTRIAS TECNOLOGICAS DE MECANIZACION Y AUTOMATIZACION, S.A., Sant Just Desvern (ES)

(72) Inventor: Manuel González, Sant Just Desvern (ES)

(73) Assignee: INDUSTRIAS TECNOLÓGICAS DE MECANIZACIÓN Y AUTOMATIZACIÓN, S.A., Sant Just Desvern (ES)

( * ) Notice: Subject to any disclaimer, the term of this patent is extended or adjusted under 35 U.S.C. 154(b) by 201 days.

(21) Appl. No.: 17/105,756

(22) Filed: Nov. 27, 2020

(65) Prior Publication Data

US 2021/0154962 A1 May 27, 2021

(30) Foreign Application Priority Data

Nov. 27, 2019 (EP) ..... 19000535

(51) Int. Cl.
*B31B 50/25* (2017.01)
*B31B 50/00* (2017.01)

(52) U.S. Cl.
CPC ..... *B31B 50/252* (2017.08); *B31B 50/005* (2017.08)

(58) Field of Classification Search
CPC .. B26D 1/09; B26D 1/095; B26D 1/20; B31B 50/252
USPC ..... 83/883
See application file for complete search history.

(56) References Cited

FOREIGN PATENT DOCUMENTS

| | | | | |
|---|---|---|---|---|
| CN | 108687825 A | * | 10/2018 | ..... B26D 1/095 |
| JP | 2000254891 A | * | 9/2000 | ..... B26D 3/08 |
| WO | WO-2019171242 A1 | * | 9/2019 | ..... B26D 1/065 |

* cited by examiner

*Primary Examiner* — Andrew M Tecco
*Assistant Examiner* — Jacob A Smith
(74) *Attorney, Agent, or Firm* — Hodgson Russ LLP

(57) ABSTRACT

This invention relates to a container pre-cutting system, applicable to multilayer and/or single-layer (3) container forming machines (4) that provide intermittent advances to the multi-layer and/or single-layer material with a length according to an advance step of the machine; said system being suitable for making a lower pre-cut (32) on the lower surface and an upper pre-cut (32) on the upper surface of the multilayer and/or single-layer material (3). The system comprises a lower pre-cutting device (1) and an upper pre-cutting device (2), provided with respective lower (11) and upper (21) blades having relative vertical movement with respect to the multilayer and/or single-layer material (3); and wherein the lower pre-cutting device (1) and the upper pre-cutting device (2) are separated in the advance direction of the multilayer and/or single-layer material (3) at a length approximately equal to a multiple of the advance step of the machine.

4 Claims, 4 Drawing Sheets

CONTAINER PRE-CUTTING SYSTEM

CROSS REFERENCE TO RELATED APPLICATION(S)

This application claims priority to European Patent Application No. European Patent Application No. 19000535.5, filed Nov. 27, 2019, the entire disclosure of which is incorporated herein by reference.

TECHNICAL FIELD

This invention is applicable to multilayer and/or single-layer container forming machines, mainly intended for packaging food products, and provides intermittent advances to the multi-layer and/or single-layer material with a length according to the advance step of the machine; the system carrying out a pre-cut on the lower surface and a pre-cut on the upper surface of the multilayer and/or single-layer container material in order to subsequently facilitate the separation of the containers of a single pack.

BACKGROUND

When manufacturing containers made of multilayer material, in particular container packs for the food industry, it is common to make pre-cutting lines on the contours of the containers that affect a part of the thickness of the multilayer material and the aim of which is to facilitate the subsequent manual tearing and separation of the pack containers by the end consumer.

In containers made with single-layer or bilayer plastic material, making the pre-cutting line on the upper surface of the material is sufficient to allow for the subsequent tearing and separation of the containers of the pack by the user.

When multilayer materials are used, this upper pre-cutting line is insufficient for guaranteeing a proper separation of the containers of the pack without producing defects in the area of the tear.

To prevent said drawbacks, in Spanish Patent Application No. P201830445, by the same holder as the present invention, a solution was developed that consists of a container pre-cutting device that comprises: a punch plate provided with upper blades to make the upper pre-cutting line, and a die plate that comprises lower blades facing the upper blades, so that when the punch plate closes on the die plate, the upper blades and the lower blades simultaneously define upper and lower pre-cutting lines on opposite faces of the multilayer material of the containers, thereby guaranteeing a proper tear of the multilayer material along said pre-cutting lines.

This solution is effective for making the upper and lower pre-cuts at the same time; however, depending on the mechanical characteristics of the materials that make up the different layers of the multilayer material, this simultaneity of the upper and lower pre-cuts, which are very close to one another, can cause stress in the multilayer material, by which neither the upper nor the lower pre-cuts are cut, leading to undesirable tears of the multilayer material in said area, either prior to or during the separation of the containers.

SUMMARY

The container pre-cutting system of this invention is applicable to multilayer and/or single-layer container forming machines, which cause intermittent advances in the multilayer and/or monolayer material with a length according to an advance step of the machine; and has suitable technical features for making a lower pre-cut and an upper pre-cut in the facing areas of the lower and upper surfaces in two phases, meaning successively, not simultaneously, making both the lower and upper pre-cuts in an advance of the multilayer and/or single-layer material of a predetermined length, thereby eliminating the stresses produced in the multilayer and/or single-layer material by making the simultaneous upper and lower pre-cuts.

Therefore, this system is especially ideal for pre-cutting multipack containers made of different materials (PET, PP, PLA and PS).

To this end, and according to the invention, this container pre-cutting system comprises a lower pre-cutting device and an upper pre-cutting device, provided with respective lower and upper blades, having relative vertical movement with respect to the multilayer and/or single-layer material; and wherein said lower and upper pre-cutting devices are separated in the advance direction of the multilayer and/or single-layer material by a length equal to a multiple of the advance step of the container forming machine.

This movement of the multilayer and/or single-layer material between the lower and upper pre-cutting devices makes it so between the upper and lower pre-cuts, the multilayer and/or single-layer material releases the stress produced during the first pre-cut, preventing the stresses from accumulating during the second pre-cut that is very close to the prior pre-cut.

According to the invention, the lower pre-cutting device comprises: a vertically movable lower die, holding the lower blade; and an upper floating stop, mounted on calibrated springs on a punch plate and against which the multilayer and/or single-layer material is moved by the lower die, during the lower pre-cutting of said multilayer and/or single-layer material.

Furthermore, the upper pre-cutting device comprises: a lower die and an upper blade mounted with the possibility of relative vertical movement with respect to a floating stop in turn provided with limited vertical movement with respect to a punch plate; said upper blade being mounted on calibrated springs.

According to one embodiment of the invention the upper and lower pre-cutting devices are defined in a double tool able to be actuated by the same press of the forming machine, which can be a current form, fill and seal machine, for example, also known as FFS machines.

Optionally, the upper and lower pre-cutting devices are defined on independent tools, installed on different presses.

In both cases the upper and lower pre-cutting devices are separated from one another by a length corresponding to several advance steps of the machine.

Lastly, it is worth mentioning that the order of the upper and lower pre-cutting devices in relation to the advance direction of the multilayer and/or single-layer material is not important, the system being able to first make the lower pre-cut and then the upper pre-cut, or vice versa, given that it does not affect the essence of the invention.

BRIEF DESCRIPTION OF THE DRAWINGS

As a complement to the description being made, and for the purpose of helping to make the features of the invention more readily understandable, this specification is accompanied by a set of drawings which, by way of illustration and not limitation, represent the following.

DETAILED DESCRIPTION

Figure 1:
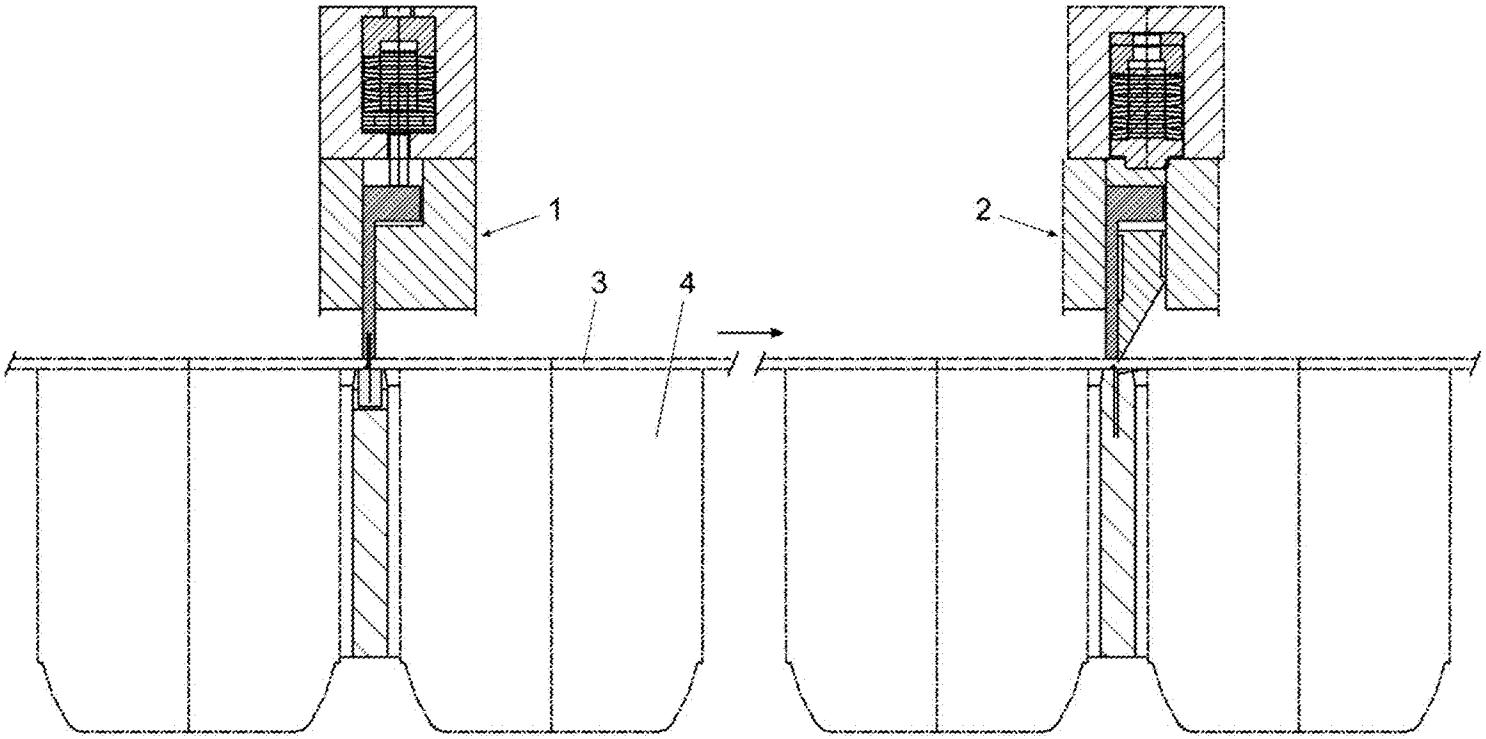
FIG. 1 shows a schematic elevation view of an exemplary embodiment of the container pre-cutting system according to the invention, wherein the lower pre-cutting device and the upper pre-cutting device can be seen longitudinally separated in the advance direction of containers formed in a sheet of multilayer and/or single-layer material.

In FIG. 1 the container pre-cutting system comprises a lower pre-cutting device (1) and an upper pre-cutting device (2) intended to be mounted on a container forming machine (4), made with multilayer and/or single-layer material (3) and which, when actuated, make both pre-cuts in the lower surface and in the upper surface of the multilayer material (3).

It must be mentioned that in the aforementioned FIG. 1, the lower pre-cutting device (1) and the upper pre-cutting device (2) are in this order in the advance direction of the multilayer and/or single-layer material (3), although it could be in the opposite order, since the order does not affect the operation of the system.

The lower pre-cut device (1) and upper pre-cut device (2) are longitudinally separated in the advance direction of the multilayer material (3) by a length equal to a multiple of the advance step of the container forming machine, such that the lower and upper pre-cutting lines corresponding to the same area of multilayer and/or single-layer material (3) are not made simultaneously, but rather in two successive phases.

Figure 2:
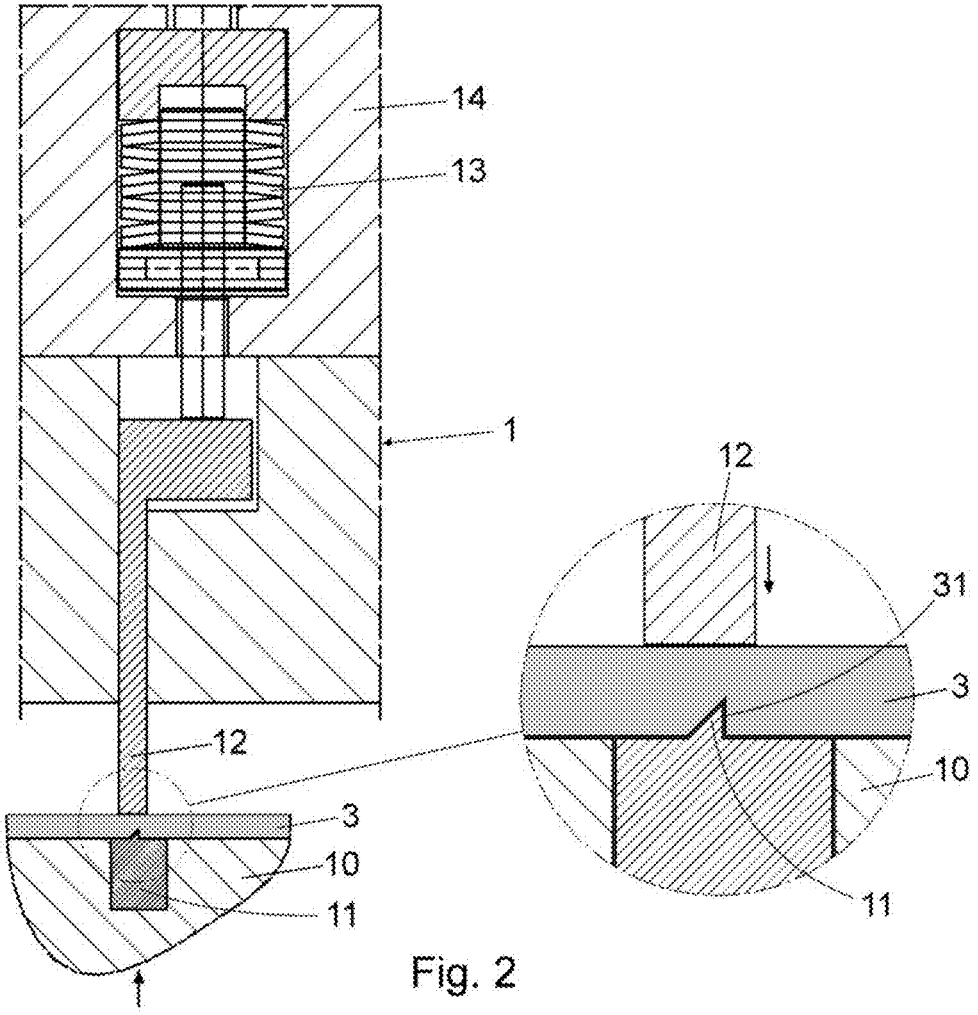
FIG. 2 shows an elevation view of the lower pre-cutting device, wherein the lower blade is fixed to the lower die; and a detailed enlargement of the pre-cutting area of the same.

In the exemplary embodiment shown in FIG. 2, the lower pre-cutting device (1) comprises: a lower die (10), able to move vertically, to which a lower blade (11) is fixed; and an upper floating stop (12) mounted on calibrated springs (13) on a punch plate (14).

When the lower die (10) moves towards the upper area, as shown in FIG. 2, it pushes the multilayer material (3) against the upper floating stop (12), the lower blade (11) making a lower pre-cut (31) in the multilayer and/or single-layer material (3).

Figure 3:
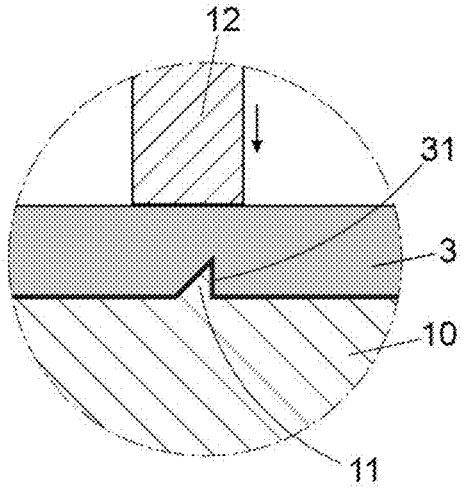
FIG. 3 shows a detailed enlargement of an embodiment variant of the lower pre-cutting device, wherein the lower blade is machined in the lower die itself.

It is worth mentioning that the lower blade (11) can be fixed to the lower die (10) as shown in FIG. 2, or be directly machined on said lower die (10) as shown in the detail of FIG. 3.

To make a pre-cut facing the aforementioned lower pre-cut (31) in the upper surface of the multilayer and/or single-layer material (3), it is necessary for the multilayer and/or single-layer material to move a specific number of advance steps of the machine, until said area reaches the upper pre-cutting device (2).

Figure 4:
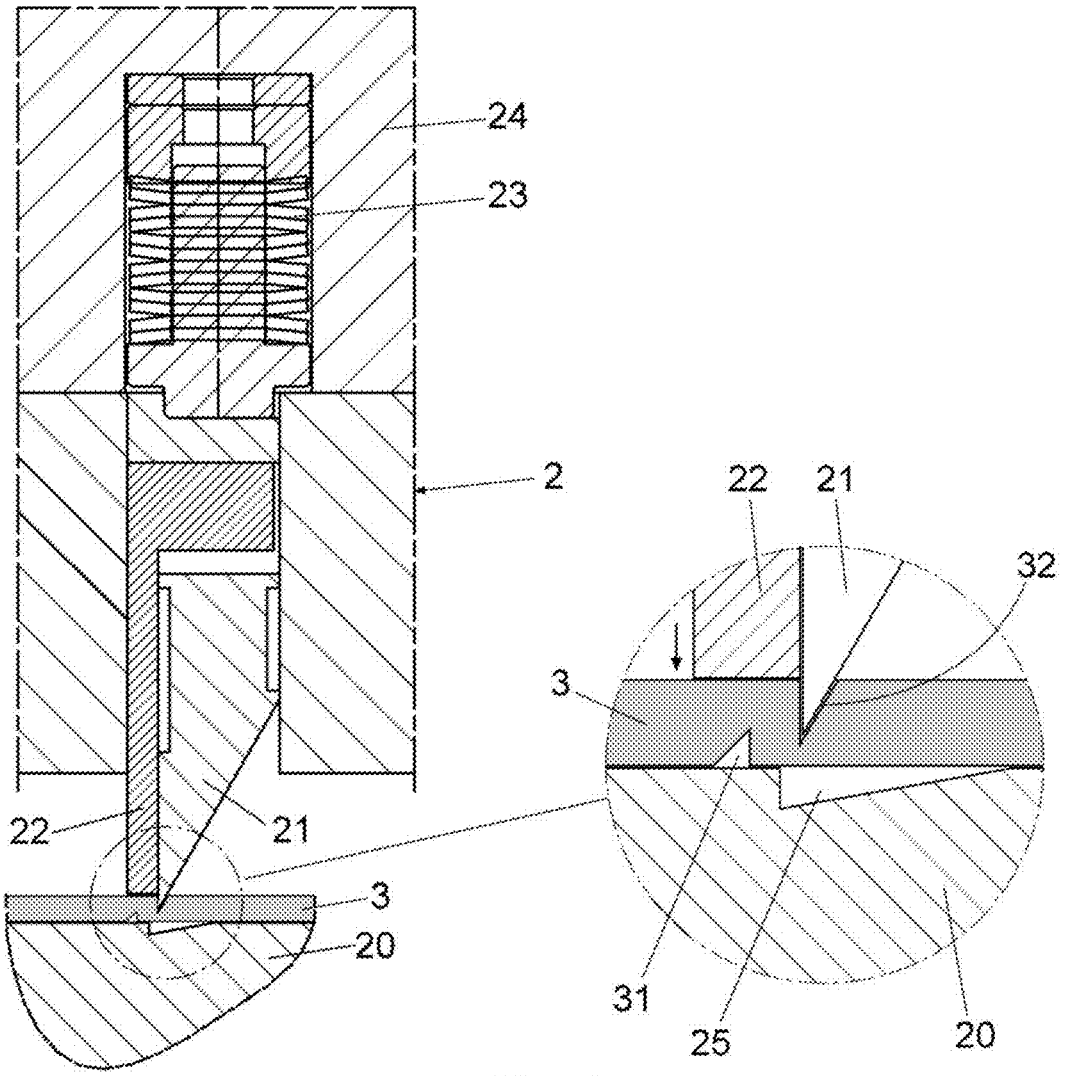
FIG. 4 shows an elevation view of the upper pre-cutting device and a detailed enlargement of the pre-cutting area of the same.

The upper pre-cutting device (2) shown in FIG. 4 comprises: a lower die (20) and an upper blade (21) mounted with the possibility of relative vertical movement with respect to a floating stop (22) in turn provided with limited vertical movement with respect to a punch plate (24); said upper blade (21) being mounted on calibrated springs (23).

When the upper pre-cutting device (2) is actuated, the floating stop (22) presses the multilayer and/or single-layer material (3) against the lower die (20) and the upper blade (21) penetrates the upper surface of the multilayer material (3), defining the upper pre-cut (32) in the same.

As can be seen in the detailed enlargement of FIG. 4, the lower pre-cut (31) and the upper pre-cut (32) are slightly separated in the advance direction of the multilayer material (3), the lower die (20) in the area facing the upper blade (21) having a recess (25) that allows for a certain elastic deformation of the multilayer sheet (3) when making the upper pre-cut (32), which contributes to reducing the stresses of the material in the pre-cutting area.

Figure 5:
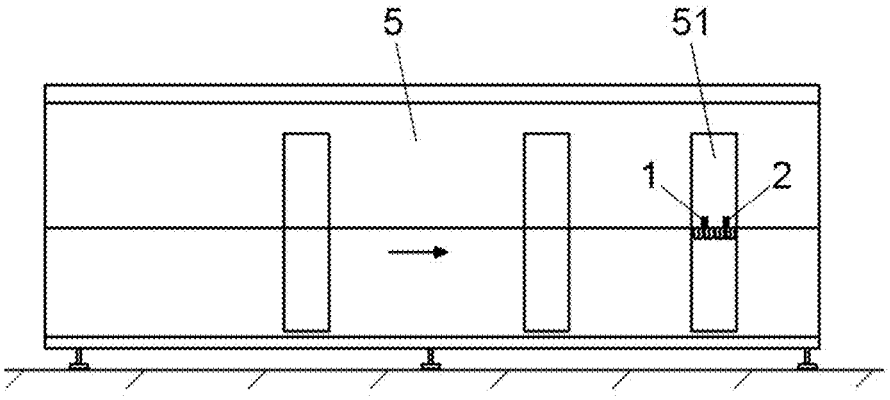
FIGS. 5, 6 and 7 schematically show different mounting embodiments of the upper and lower pre-cutting devices with respect to a form, fill and seal machine (FFS machine).
Figure 6:
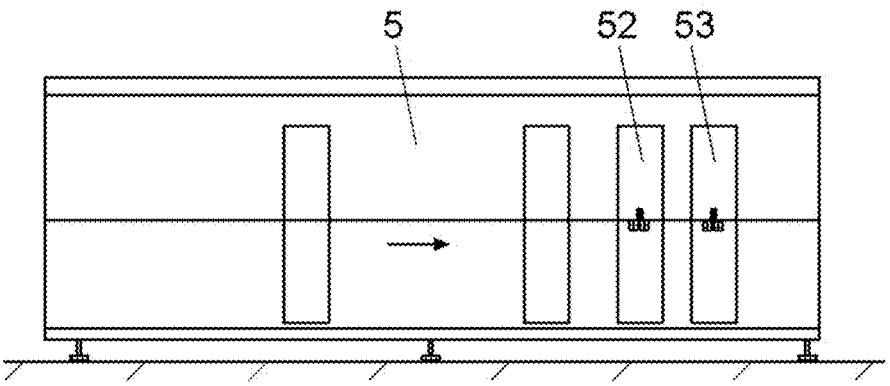
Figure 7:
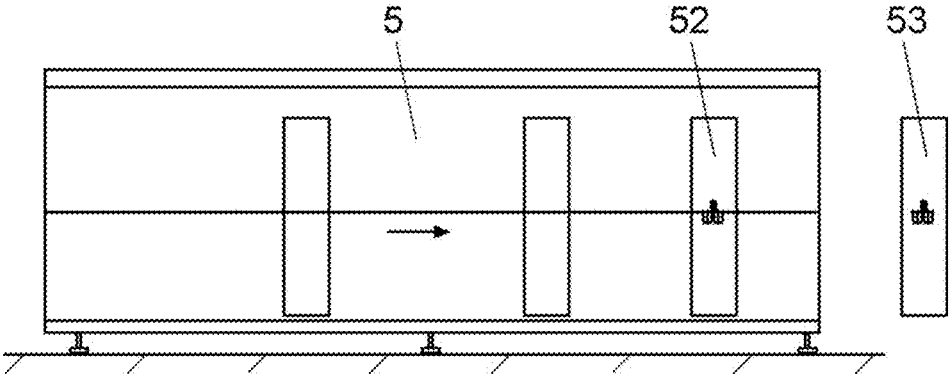

The lower pre-cutting device (1) and the upper pre-cutting device (2) can be defined in a double tool (51) able to be actuated by the same press of the forming machine (5), as schematically shown in FIG. 5; or in two independent tools (52, 53) installed on different presses, situated either in the forming machine (5), as shown in FIG. 6, or one in the forming machine and another outside the same, as shown in FIG. 7.

In any case, the separation between the lower pre-cutting device (1) and the upper pre-cutting device (2) is a multiple of the advance step of the forming machine (5) so that the lower pre-cut (31) and the upper pre-cut (32) are in facing positions, as shown in FIG. 4.

Having sufficiently described the nature of the invention, in addition to an example of preferred embodiment, it is hereby stated for the relevant purposes that the materials, shape, size and layout of the described elements may be modified, provided that it does not imply altering the essential characteristics of the invention claimed below.

What is claimed is:

1. A container pre-cutting system, applicable to a multilayer and/or a single-layer material (3) container forming machine (4) that uses intermittent advances of multilayer and/or single layer material of a length according to an advance step of the container forming machine; said system being suitable for making a lower pre-cut (32) on a lower surface and an upper pre-cut (32) on an upper surface of multilayer and/or single-layer material (3), comprising:

a lower pre-cutting device (1) and an upper pre-cutting device (2), provided with respective lower blades (11) and upper blades (21) having relative vertical movement with respect to the multilayer and/or single-layer material (3);

wherein said lower pre-cutting device (1) and upper pre-cutting device (2) are separated in an advance direction of the multilayer and/or single-layer material (3) by a length that is approximately equal to a multiple of the advance step of the container forming machine; and wherein the upper pre-cutting device (2) comprises: a lower die (20) and the upper blade (21) mounted to allow relative vertical movement with respect to a floating stop (22) in turn provided with limited vertical movement with respect to a punch plate (23); said upper blade (21) being mounted on calibrated springs (24);

wherein the multilayer and/or single-layer material (3) is configured to press against the lower die (20) when the upper pre-cutting device (2) is actuated.

2. The container pre-cutting system according to claim 1, wherein the lower pre-cutting device (1) and the upper pre-cutting device (2) are defined on a double tool (51) able to be actuated by a same press of the container forming machine (5).

3. The container pre-cutting system according to claim 1, wherein the lower pre-cutting device (1) and the upper pre-cutting device (2) are defined on independent tools (52, 53), installed on different presses and separated from one another by a multiple length of the advance step of the container forming machine.

4. A container pre-cutting system, applicable to a multilayer and/or a single-layer material (3) container forming machine (4) that uses intermittent advances of multilayer and/or single layer material of a length according to an advance step of the container forming machine; said system being suitable for making a lower pre-cut (32) on a lower surface and an upper pre-cut (32) on an upper surface of multilayer and/or single-layer material (3), comprising:

a lower pre-cutting device (1) and an upper pre-cutting device (2), provided with respective lower blades (11) and upper blades (21) having relative vertical movement with respect to the multilayer and/or single-layer material (3);

wherein said lower pre-cutting device (1) and upper pre-cutting device (2) are separated in an advance direction of the multilayer and/or single-layer material (3) by a length that is approximately equal to a multiple of the advance step of the container forming machine; and wherein the container pre-cutting system further comprises a lower die (20) having a recess (25) in an area facing the upper blade (21) that is configured to allow elastic deformation of the single-layer material (3) when making the upper pre-cut (32);

wherein the multilayer and/or single-layer material (3) is configured to press against the lower die (20) when the upper pre-cutting device (2) is actuated.

* * * * *